US007612788B2

(12) United States Patent
Chang et al.

(10) Patent No.: US 7,612,788 B2
(45) Date of Patent: Nov. 3, 2009

(54) DRIVING MULTIPLE SUB-PIXELS FROM SINGLE GRAY SCALE DATA

(75) Inventors: Il-Kwon Chang, Gimpo-Si (KR); Yong-Weon Jeon, Suwon-Si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 667 days.

(21) Appl. No.: 11/208,498

(22) Filed: Aug. 22, 2005

(65) Prior Publication Data

US 2006/0158420 A1 Jul. 20, 2006

(30) Foreign Application Priority Data

Jan. 18, 2005 (KR) ..... 10-2005-0004539

(51) Int. Cl.
*G09G 5/10* (2006.01)

(52) U.S. Cl. ..... 345/690; 345/89; 345/98; 345/100

(58) Field of Classification Search ..... 345/98, 345/100, 690
See application file for complete search history.

(56) References Cited

U.S. PATENT DOCUMENTS 5,196,738 A * 3/1993 Takahara et al. ..... 327/530
7,355,577 B1 * 4/2008 Bell et al. ..... 345/87
2002/0011979 A1 * 1/2002 Nitta et al. ..... 345/89
2002/0024511 A1 * 2/2002 Ozawa ..... 345/204
2003/0151616 A1 * 8/2003 Morita ..... 345/690
2004/0263448 A1 * 12/2004 Baek et al. ..... 345/87
2005/0001858 A1 * 1/2005 Morita et al. ..... 345/690
2005/0253797 A1 * 11/2005 Kamada et al. ..... 345/89

OTHER PUBLICATIONS

"All-MOS Charge Redistribution Analog-to-Digital Conversion Techniques—Part II", Ricardo E. Suarez et al., IEEE Journal of Solid State Circuits, vol. SC-10, No. 6, Dec. 1975, pp. 379-385.

* cited by examiner

*Primary Examiner*—Amare Mengistu
*Assistant Examiner*—Koosha Sharifi
(74) *Attorney, Agent, or Firm*—Monica H. Choi

(57) ABSTRACT

For generating source line voltages in a display device, gray scale data is received at a source driver for a first sub-pixel of a pixel. The source driver generates a first source line voltage for the first sub-pixel and a second source line voltage for a second sub-pixel from the gray scale data of the first sub-pixel. Thus, data transfer rate and/or data buses are minimized for in turn minimizing power consumption and EMI (electromagnetic interference).

30 Claims, 9 Drawing Sheets

| ABR | Output of Upper A/B Selector | Output of Lower A/B Selector | POL | Output of Upper/Lower Selector | S1, S2, S3 | VH | VL |
|---|---|---|---|---|---|---|---|
| 0 | VUM1, VUM2 | VLM1, VLM2 | 0 | VUH, VUM1, VUM2, VUL | 1, 0, 0 | VUH | VUM1 |
| | | | | | 0, 1, 0 | VUM1 | VUM2 |
| | | | | | 0, 0, 1 | VUM2 | VUL |
| 0 | VUM1, VUM2 | VLM1, VLM2 | 1 | VLH, VLM1, VLM2, VLL | 1, 0, 0 | VLH | VLM1 |
| | | | | | 0, 1, 0 | VLM1 | VLM2 |
| | | | | | 0, 0, 1 | VLM2 | VLL |
| 1 | VUM1', VUM2' | VLM1', VLM2' | 0 | VUH, VUM1', VUM2', VUL | 1, 0, 0 | VUH | VUM1' |
| | | | | | 0, 1, 0 | VUM1' | VUM2' |
| | | | | | 0, 0, 1 | VUM2' | VUL |
| 1 | VUM1', VUM2' | VLM1', VLM2' | 1 | VLH, VLM1', VLM2', VLL | 1, 0, 0 | VLH | VLM1' |
| | | | | | 0, 1, 0 | VLM1' | VLM2' |
| | | | | | 0, 0, 1 | VLM2' | VLL |

*FIG. 8*

DRIVING MULTIPLE SUB-PIXELS FROM SINGLE GRAY SCALE DATA

CROSS-REFERENCE TO RELATED APPLICATION(S)

The present application claims priority under 35 U.S.C. §119 to Korean Patent Application No. 2005-04539, filed on Jan. 18, 2005, which is incorporated herein by reference in its entirety.

TECHNICAL FIELD

The present invention relates generally to display devices such as LCD (liquid crystal display) panels, and more particularly, to driving multiple sub-pixels from gray scale data for one of the sub-pixels for minimized power consumption and EMI (electromagnetic interference).

BACKGROUND OF THE INVENTION

When a large panel display such as a large liquid crystal display (LCD) is viewed at a wide angle, the color of the displayed image may not be clearly viewed because of light scattering. One method of dealing with such light scattering is the 2-TFT (thin film transistor) method for the LCD.

FIG. 1 shows a 2-TFT pixel 100 including a first sub-pixel 102 and a second sub-pixel 104. The first sub-pixel 102 includes a first TFT (thin film transistor) MNA having a drain coupled to a first sub-pixel electrode represented as a first storage capacitor Cst-a and a first liquid crystal capacitor Clc-a coupled between the first storage capacitor Cst-a and a ground node. The second sub-pixel 104 includes a second TFT (thin film transistor) MNB having a drain coupled to a second sub-pixel electrode represented as a second storage capacitor Cst-b and a second liquid crystal capacitor Clc-b coupled between the second storage capacitor Cst-b and the ground node.

The first and second storage capacitors Cst-a and Cst-b are coupled to each other at a coupling node Cst. The first TFT MNA has a gate coupled to a first gate line Gate-a, and the second TFT MNB has a gate coupled to a second gate line Gate-b. The first and second TFT's MNA and MNB have sources coupled to a source line 106.

For displaying gray scale data at the pixel 100, a respective voltage ΔV is desired to be biased across each of the storage capacitors Cst-a and Cst-b and each of the liquid crystal capacitors Clc-a and Clc-b, in accordance to the luminance curves of FIG. 2. Referring to FIG. 2, for any given gray scale data to be displayed at the pixel 100, a first respective voltage ΔV1 for that gray scale data is desired to be biased across the first storage and liquid crystal capacitors Cst-a and Clc-a, and a lower second respective voltage ΔV2 for that gray scale data is desired to be biased across the second storage and liquid crystal capacitors Cst-b and Clc-b.

During operation of the pixel 100, the first gate line Gate-a is activated to turn on the first TFT MNA (while the second TFT MNB is turned off) to bias the first storage and liquid crystal capacitors Cst-a and Clc-a with the first respective voltage ΔV1 at the source line 106 while the coupling node Cst is biased to a VCOM voltage (i.e., a voltage at a common electrode of the display panel having the pixel 100). Thereafter, the second gate line Gate-b is activated to turn on the second TFT MNB (while the first TFT MNA is turned off) to bias the second storage and liquid crystal capacitors Cst-b and Clc-b with the second respective voltage ΔV2 at the source line 106 while the coupling node Cst is biased to the VCOM voltage.

With such different biases, the first sub-pixel 102 exhibits a first luminance, and the second sub-pixel 104 exhibits a second luminance that is different from the first luminance. Referring to FIG. 2, the pixel 100 exhibits an average luminance that is an average of the first and second luminances from the first and second pixels 102 and 104, in accordance with the average luminance curve 108 (shown as a dashed line in FIG. 2).

In the prior art 2-TFT method, two voltages ΔV1 and ΔV2 are independently transferred from a timing controller to a source driver for driving the source line 106 with the two voltages ΔV1 and ΔV2 during one line time period for driving the multiple sub-pixels 102 and 104. Thus, the data transfer rate and/or the number of data buses are increased by two times which disadvantageously in turn increases power consumption and EMI (electromagnetic interference).

Thus, a mechanism is desired for driving the multiple sub-pixels 102 and 104 of the pixel 100 with minimized data transfer rate and/or number of data buses.

SUMMARY OF THE INVENTION

Accordingly, in a general aspect of the present invention, multiple sub-pixels are driven from a single gray scale data for one sub-pixel.

For generating source line voltages in a display device in one aspect of the present invention, gray scale data is received at a source driver for a first sub-pixel of a pixel. The source driver generates a first source line voltage for the first sub-pixel from the gray scale data, and further generates a second source line voltage for a second sub-pixel of the pixel from the gray scale data of the first sub-pixel.

In another embodiment of the present invention, the first source line voltage is generated from the gray scale data and a first luminance curve, and the second source line voltage is generated from the gray scale data of the first sub-pixel and a second luminance curve.

For example, for generating the first source line voltage, first high and low reference voltages for a D/A (digital to analog) converter are selected from the first luminance curve depending on at least one most-significant bit of the gray scale data. At least one least-significant bit of the gray scale data is then digital to analog converted at the D/A converter with the selected first high and low reference voltages.

Similarly, for generating the second source line voltage, second high and low reference voltages are selected for the D/A converter from the second luminance curve depending on the at least one most-significant bit of the gray scale data. At least one least-significant bit of the gray scale data is then digital to analog converted at the D/A converter with the selected second high and low reference voltages. In a further embodiment of the present invention, the D/A converter is linear.

In another embodiment of the present invention, the first and second luminance curves together are for upper gamma reference voltages or for lower gamma reference voltages. Upper gamma reference voltages are used for driving the sub-pixels in positive polarity, and lower gamma reference voltages are used for driving the sub-pixels in negative polarity. In an example embodiment of the present invention, the luminance curves for the upper and lower gamma reference voltages are alternately used for generating successive sets of first and second source line voltages. In that case, the first and second source line voltages are generated during one line-time.

In this manner, first and second source line voltages for driving multiple sub-pixels are generated from a single gray scale data for one sub-pixel. Thus, since the single gray scale data is transferred, data transfer rate and/or data buses are minimized for in turn minimizing power consumption and EMI (electromagnetic interference).

These and other features and advantages of the present invention will be better understood by considering the following detailed description of the invention which is presented with the attached drawings.

BRIEF DESCRIPTION OF THE DRAWINGS

FIG. 8 shows a table of VH and VL values generated by the reference voltage generator of FIG. 4, according to an embodiment of the present invention;

The figures referred to herein are drawn for clarity of illustration and are not necessarily drawn to scale. Elements having the same reference number in FIGS. 1, 2, 3, 4, 5, 6, 7, 8, 9, and 10 refer to elements having similar structure and/or function.

DETAILED DESCRIPTION

Figure 1:
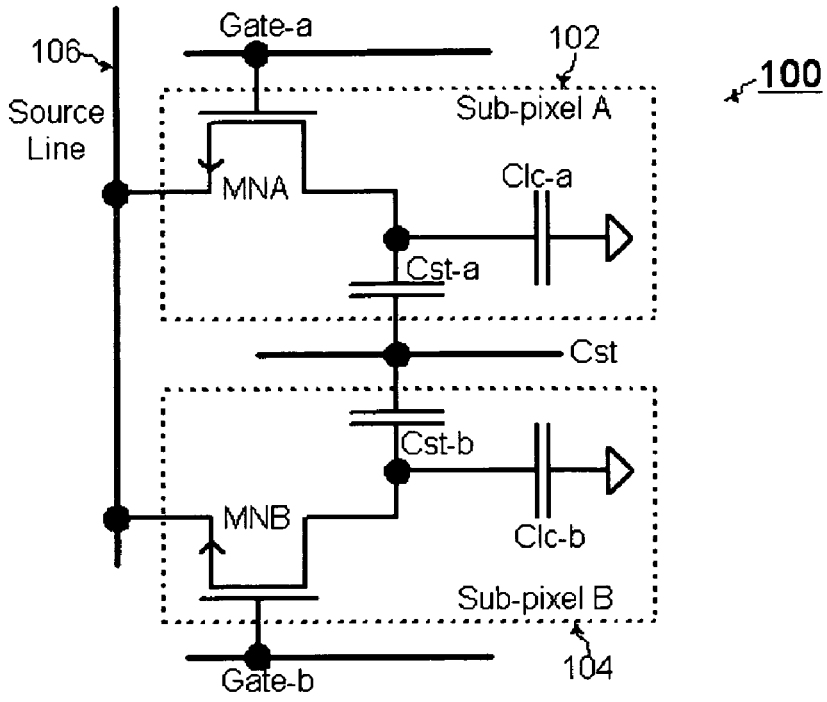
FIG. 1 (Prior Art)
FIG. 1 shows an example pixel with two sub-pixels, according to the prior art.
Figure 2:
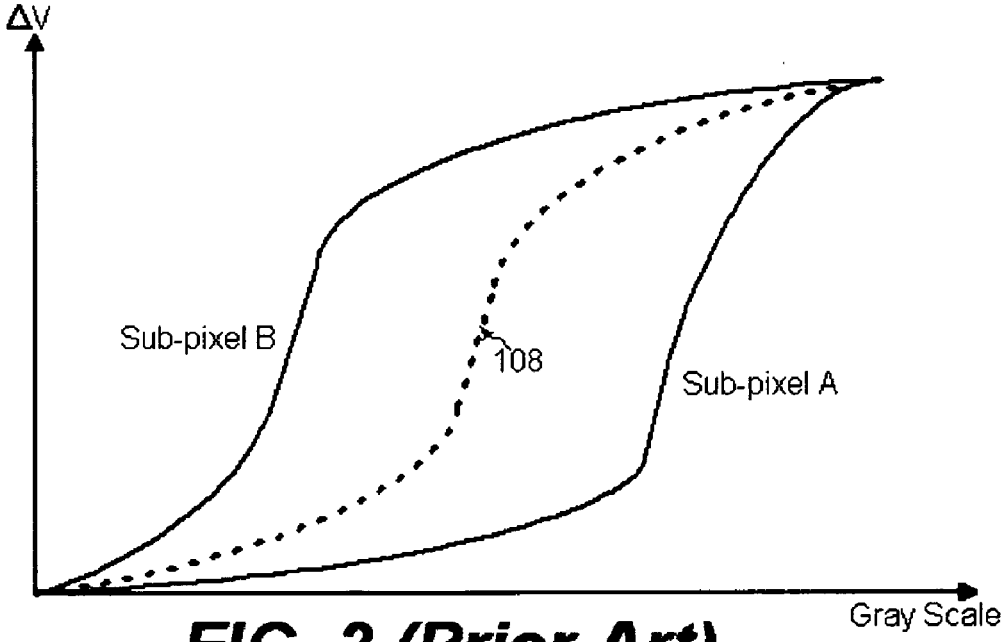
FIG. 2 (Prior Art)
FIG. 2 shows luminance curves for driving the two sub-pixels of FIG. 1, according to the prior art.
Figure 3:
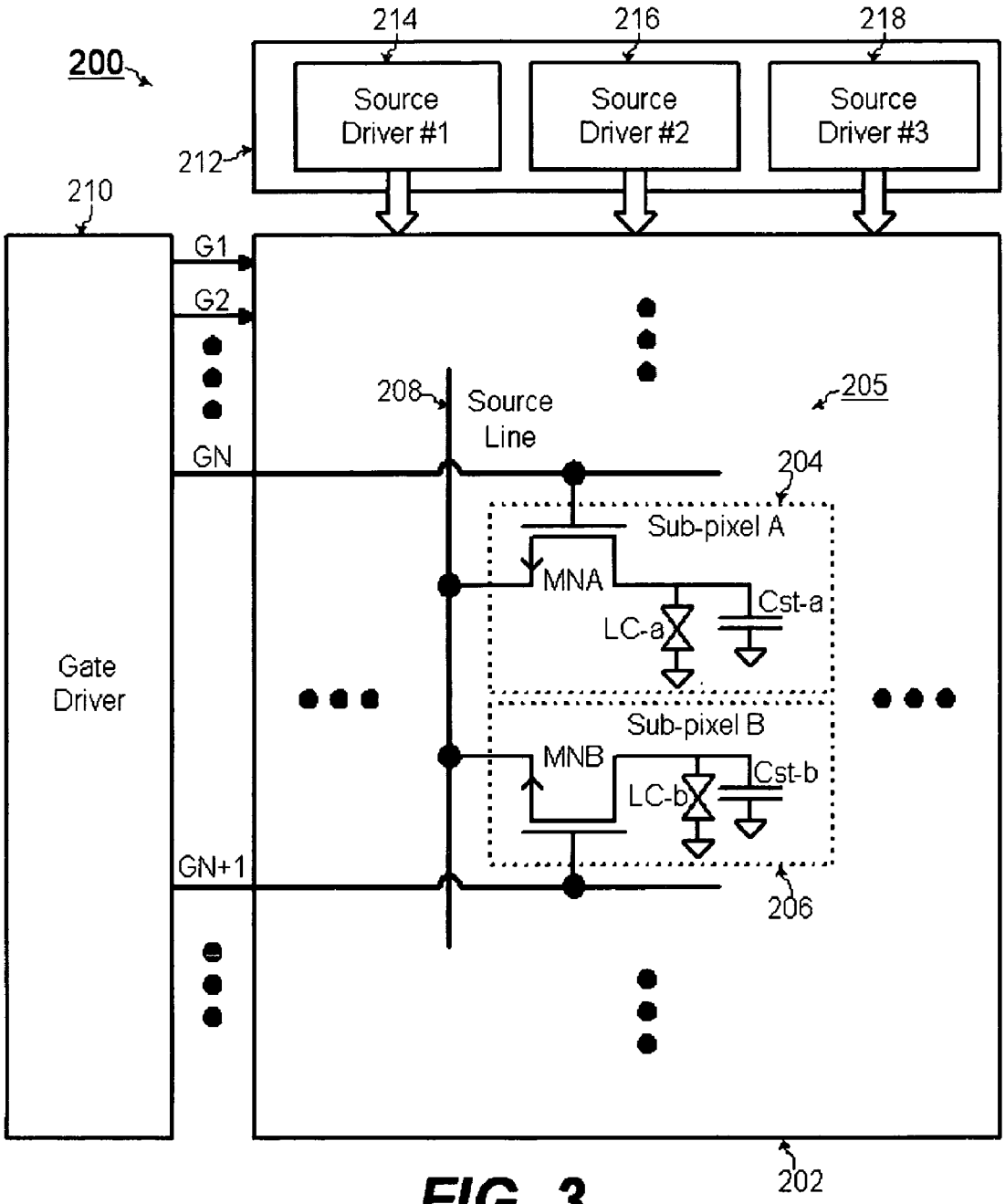
FIG. 3 shows components of a display device for driving multiple sub-pixels from a single gray scale data for one sub-pixel, according to an embodiment of the present invention.

FIG. 3 shows a display device 200 with components for driving multiple sub-pixels from a single gray scale data for one sub-pixel, according to an embodiment of the present invention. The display device includes a display panel 202 having an array of pixels with multiple sub-pixels for improved wide angle viewing. FIG. 3 shows an example of such a pixel 205 with a first sub-pixel 204 and a second sub-pixel 206.

The first sub-pixel 204 includes a first TFT (thin film transistor) MNA having a drain coupled to a first sub-pixel electrode represented as a first storage capacitor Cst-a and a first liquid crystal LC-a. The second sub-pixel 206 includes a second TFT (thin film transistor) MNB having a drain coupled to a second sub-pixel electrode represented as a second storage capacitor Cst-b and a second liquid crystal LC-b. The other node of each of the storage capacitors Cst-a and Cst-b and the liquid crystals LC-a and LC-b is grounded in the example embodiment of FIG. 3.

The first TFT MNA has a gate coupled to a first gate line GN, and the second TFT MNB has a gate coupled to a second gate line GN+1. The first and second TFT's MNA and MNB have sources coupled to a source line 208. The display device 200 includes a gate driver 210 that sequentially activates each signal on the gate lines G1, G2, . . . , GN, GN+1, . . . , and so on for the display panel 202.

Additionally, the display device 200 also includes a source driver block 212. For the large display panel 202, the source driver block 212 includes a plurality of source drivers 214, 216, and 218. Each of the source drivers 214, 216, and 218 drives a respective set of source lines in the display panel 202.

Figure 4:
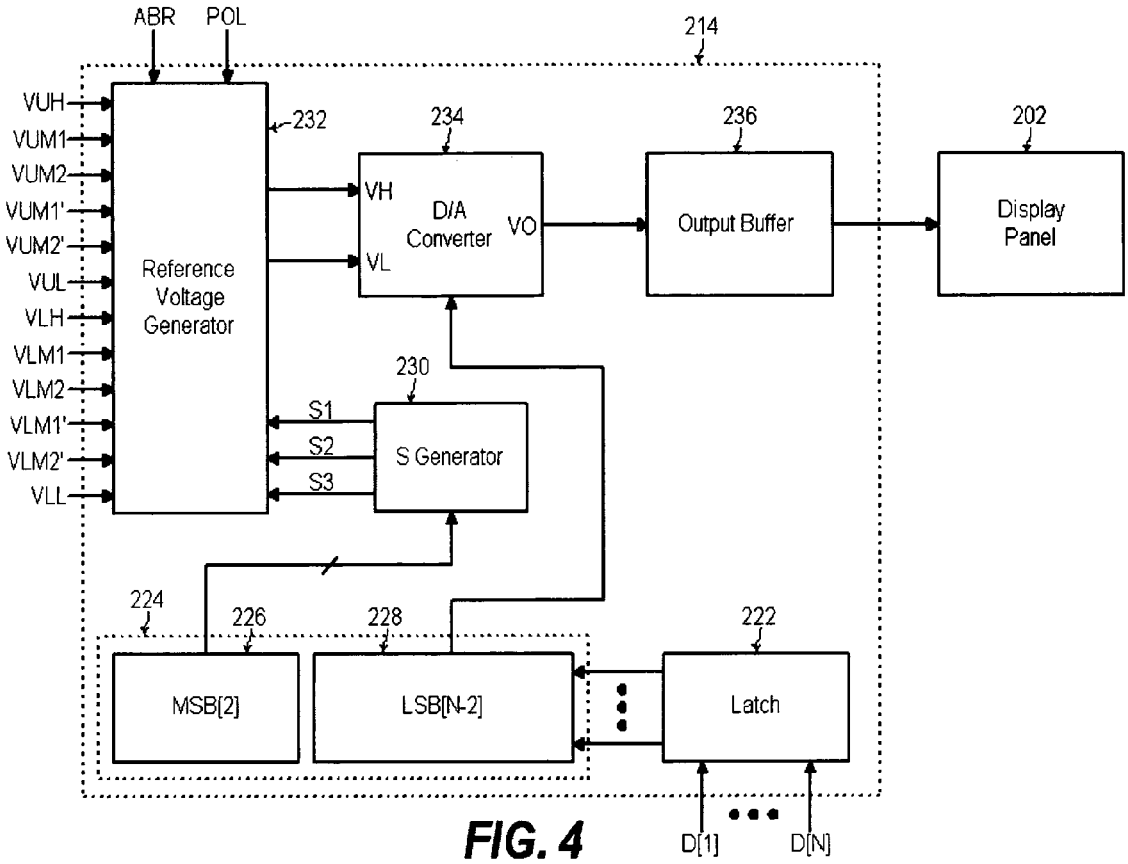
FIG. 4 shows a block diagram of a source driver of FIG. 3, according to an embodiment of the present invention.

FIG. 4 shows components for an example source driver 214, according to an embodiment of the present invention. The source driver 214 includes a first latch 222 and a second latch 224 for storing a most significant bits portion 226 and a least significant bits portion 228. The source driver 214 also includes an S-generator 230, a reference voltage generator 232, a D/A (digital to analog) converter 234, and an output buffer 236.

Figure 5:
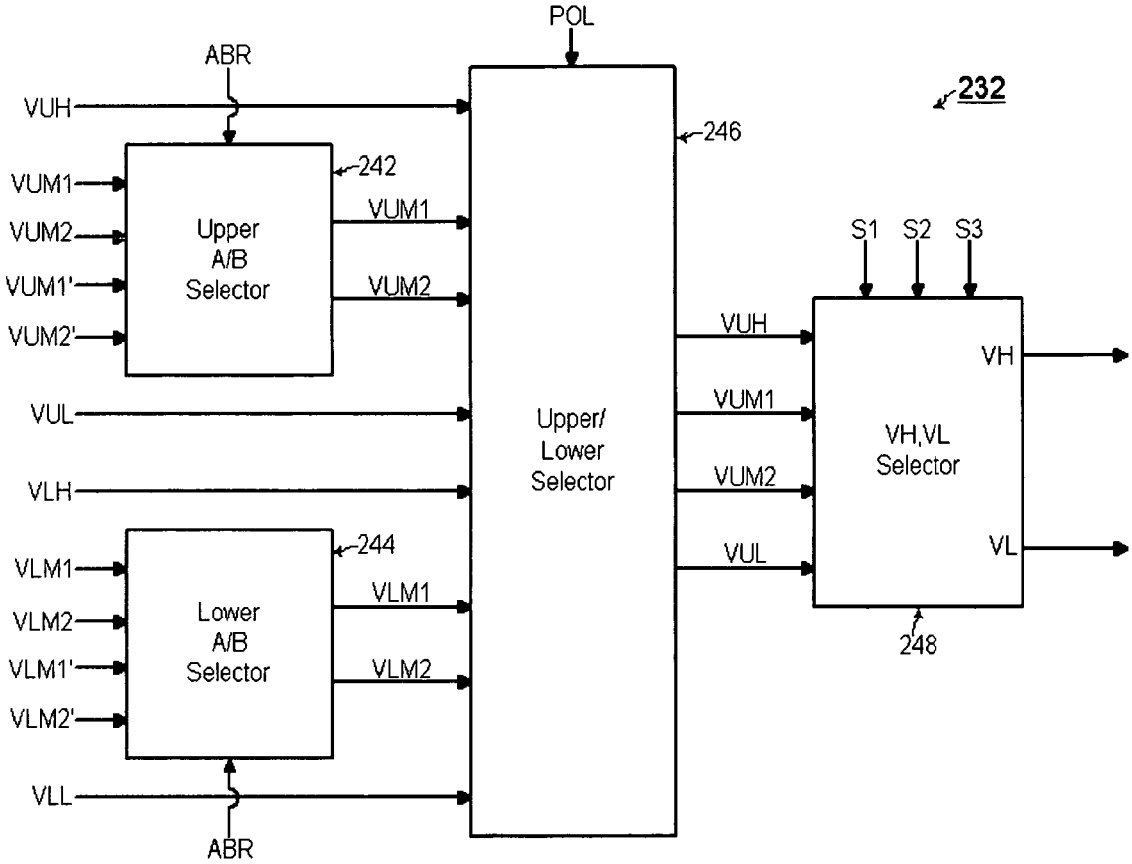
FIG. 5 shows a block diagram of a reference voltage generator of FIG. 4, according to an embodiment of the present invention.

FIG. 5 shows a block diagram of the reference voltage generator 232 of FIG. 4, according to an embodiment of the present invention. The reference voltage generator 232 includes an upper A/B selector 242, a lower A/B selector 244, an upper/lower selector 246, and a VH,VL selector 248.

Figure 6A:
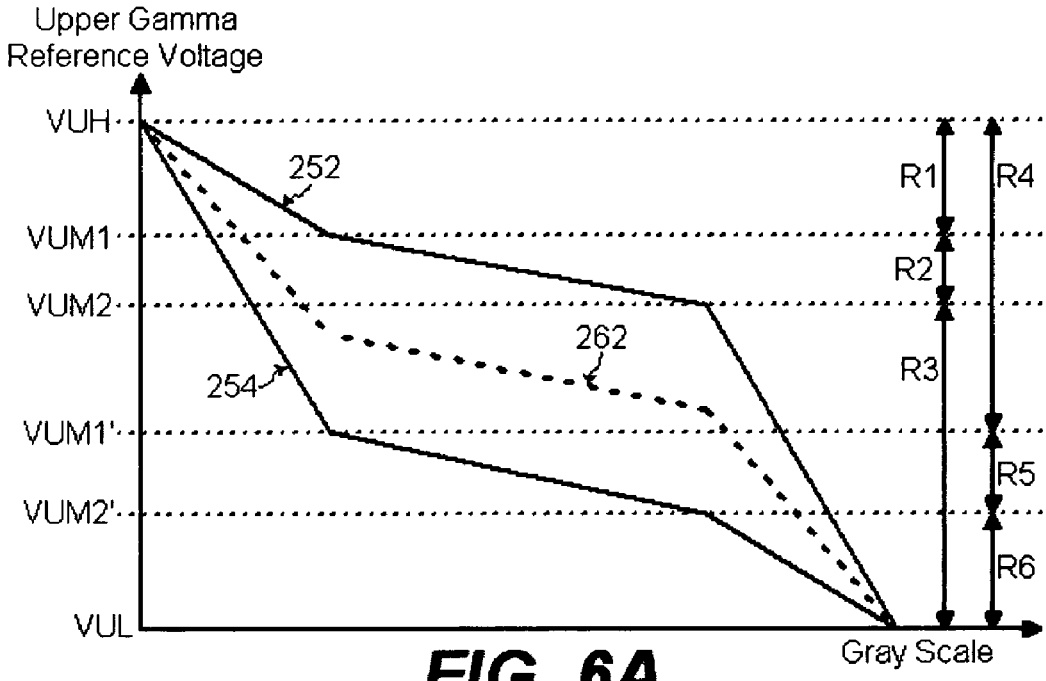
FIGS. 6A and 6B show upper and lower gamma reference voltage luminance curves used in the reference voltage generator of FIG. 5, according to an embodiment of the present invention.
Figure 6B:
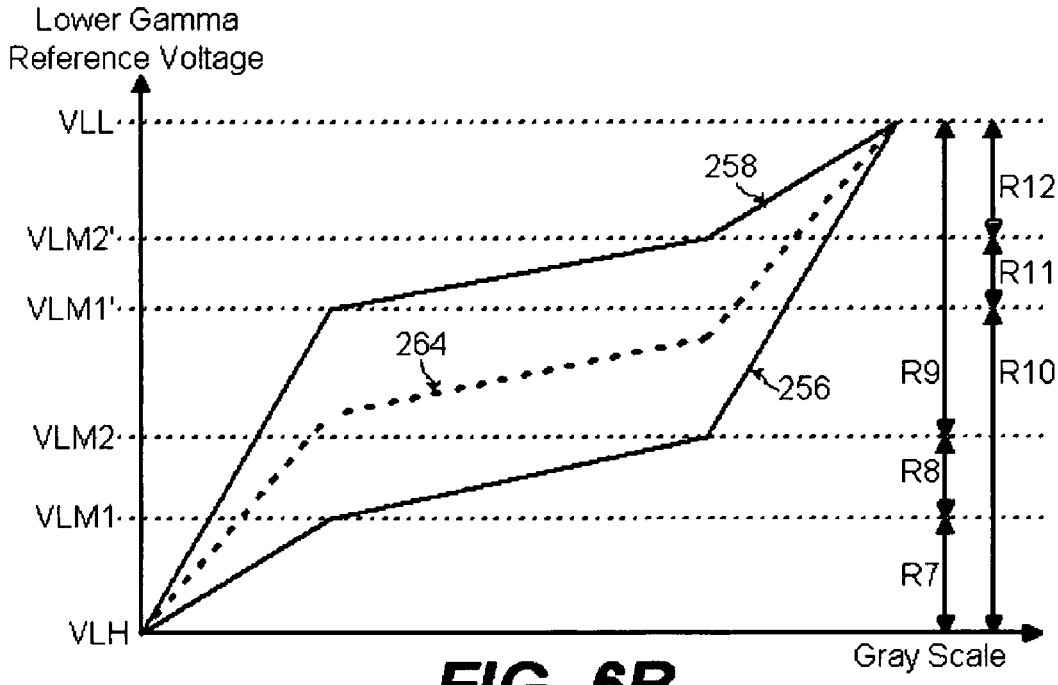

The reference voltage generator 232 inputs a plurality of gamma reference voltages VUH, VUM1, VUM2, VUM1', VUM2', VUL, VLH, VLM1, VLM2, VLM1', VLM2', and VLL. Such gamma reference voltages are defined by a plurality of luminance curves for the first and second sub-pixels 204 and 206, as illustrated in FIGS. 6A and 6B.

The upper gamma reference voltages VUH, VUM1, VUM2, VUM1', VUM2', and VUL are defined from a first luminance curve 252 for the first sub-pixel 204 and a second luminance curve 254 for the second sub-pixel 206. The first luminance curve 252 is a plot of a desired voltage across the first storage capacitor Cst-a and the first liquid crystal LC-a for each gray scale data, when a polarity signal POL indicates positive polarity. The second luminance curve 254 is a plot of a desired voltage across the second storage capacitor Cst-b and the second liquid crystal LC-b for each gray scale data, when the polarity signal POL indicates positive polarity.

The lower gamma reference voltages VLH, VLM1, VLM2, VLM1', VLM2', and VLL are defined from a third luminance curve 256 for the first sub-pixel 204 and a fourth luminance curve 258 for the second sub-pixel 206. The third luminance curve 256 is a plot of a desired voltage across the first storage capacitor Cst-a and the first liquid crystal LC-a for each gray scale data, when a polarity signal POL indicates negative polarity. The fourth luminance curve 258 is a plot of a desired voltage across the second storage capacitor Cst-b and the second liquid crystal LC-b for each gray scale data, when the polarity signal POL indicates negative polarity.

The voltages for the first and second luminance curves 252 and 254 are disposed above a common voltage VCOM for when the polarity signal POL indicates positive polarity. The voltages for the third and fourth luminance curves 256 and 258 are disposed below the common voltage VCOM for when the polarity signal POL indicates negative polarity. With such voltages driving the sub-pixels 204 and 206, the luminance exhibited by the pixel 205 as a whole is according to a first average luminance curve 262 (represented by the dashed line in FIG. 6A) when the polarity signal POL indicates positive polarity and according to a second average luminance curve 264 (represented by the dashed line in FIG. 6B) when the polarity signal POL indicates negative polarity.

Further referring to FIG. 6A, a first linear range R1 is formed between the reference voltages VUH and VUM1, a second linear range R2 is formed between the reference voltages VUM1 and VUM2, and a third linear range R3 is formed between the reference voltages VUM2 and VUL, for the first luminance curve 252. Additionally, a fourth linear range R4 is formed between the reference voltages VUH and VUM1', a fifth linear range R5 is formed between the reference voltages VUM1' and VUM2', and a sixth linear range R6 is formed between the reference voltages VUM2' and VUL, for the second luminance curve 254.

Referring to FIG. 6B, a seventh linear range R7 is formed between the reference voltages VLH and VLM1, an eighth linear range R8 is formed between the reference voltages VLM1 and VLM2, and a ninth linear range R9 is formed between the reference voltages VLM2 and VLL, for the third luminance curve 256. Additionally, a tenth linear range R10 is formed between the reference voltages VLH and VLM1', an eleventh linear range R11 is formed between the reference voltages VLM1' and VLM2', and a twelfth linear range R12 is formed between the reference voltages VLM2' and VLL, for the fourth luminance curve 258.

Figure 7:
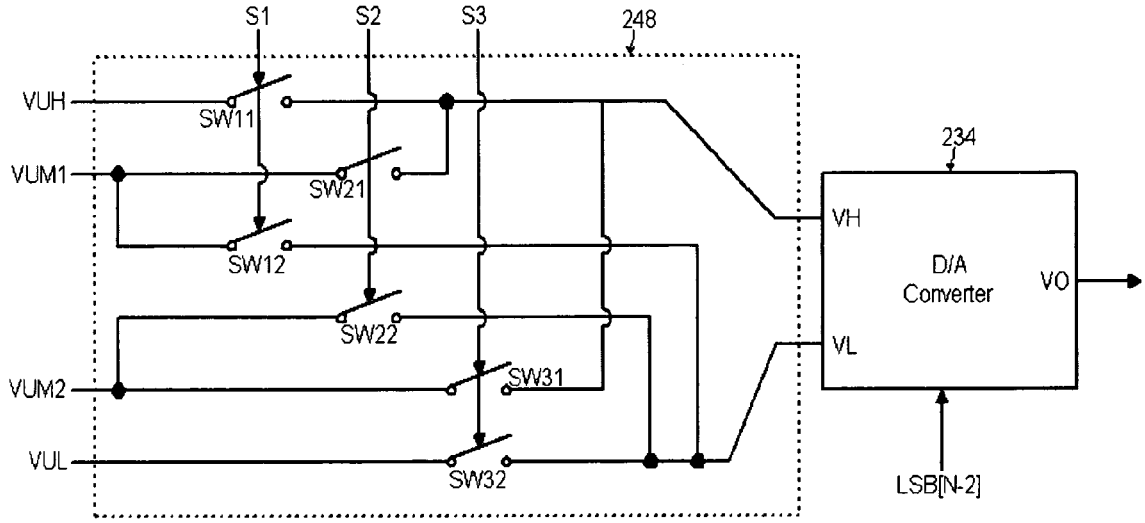
FIG. 7 shows components of a VH,VL selector of FIG. 5, according to an embodiment of the present invention.

FIG. 7 shows components of the VH,VL selector 248 in FIG. 5 according to an embodiment of the present invention. The VH,VL selector 248 inputs four reference voltages as output from the upper/lower selector 246. The VH,VL selector 248 includes three pairs of switches including a first pair of switches SW11 and SW12, a second pair of switches SW21 and SW22, and a third pair of switches SW31 and SW32. One of the pairs of switches is closed depending on which one of the select signals S1, S2, and S3 is activated to select one of the reference voltages as a high DAC (digital to analog converter) voltage VH and one of the reference voltages as a low DAC voltage VL to be used by the D/A converter 234.

FIG. 8 shows a table of the high DAC voltage VH and the low DAC voltage VL output by the reference voltage generator 232 depending on the signals ABR, POL, S1, S2, and S3. The A/B ratio signal ABR indicates which of the first and second sub-pixels 204 and 206 is currently to be driven. Referring to FIGS. 4 and 5, when the ABR signal is at a low logic state "0", the upper A/B selector outputs VUM1 and VUM2 to the upper/lower selector 246, and the lower A/B selector outputs VLM1 and VLM2 to the upper/lower selector 246. When the ABR signal is at the high logic state "1", the upper A/B selector outputs VUM1' and VUM2' to the upper/lower selector 246, and the lower A/B selector outputs VLM1' and VLM2' to the upper/lower selector 246.

The upper/lower selector 246 inputs a first set of reference voltages for driving with voltages above VCOM and a second set of reference voltages for driving with voltages below VCOM. When the ABR signal and the POL (polarity) signal are each at the logic low state "0", the upper/lower selector 246 outputs a first set of four reference voltages VUH, VUM1, VUM2, and VUL. When the ABR signal is at the logic low state "0" and the POL (polarity) signal is at the logic high state "1", the upper/lower selector 246 outputs a second set of four reference voltages VLH, VLM1, VLM2, and VLL.

When the ABR signal is at the logic high state "1" and the POL (polarity) signal is at the logic low state "0", the upper/lower selector 246 outputs a third set of four reference voltages VUH, VUM1', VUM2', and VUL. When the ABR signal and the POL (polarity) signal are each at the logic high state "1", the upper/lower selector 246 outputs a fourth set of four reference voltages VLH, VLM1', VLM2', and VLL.

Referring to FIGS. 7 and 8, the VH,VL selector 248 inputs the set of four reference voltages as output from the upper/lower selector 246. The VH,VL selector 248 selects one of such four reference voltages as VH and another one of such four reference voltages as VL, depending on which one of the S1, S2, and S3 signals are activated to the logic high state "1" as shown in the Table of FIG. 8. Referring to FIGS. 6, 7, and 8, the VH and VL selected by the VH,VL selector 248 are upper and lower boundaries of one of the ranges R1, R2, R3, R4, R5, R6, R7, R8, R9, R10, R11, and R12.

Referring to FIGS. 4 and 8, one of the S1, S2, and S3 signals is activated depending on the two most significant bits MSB[2] of the gray scale data D[N:1]. The gray scale data D[N:1] is latched into the first latch 222 and is then transferred to the second latch 224.

Figure 9:
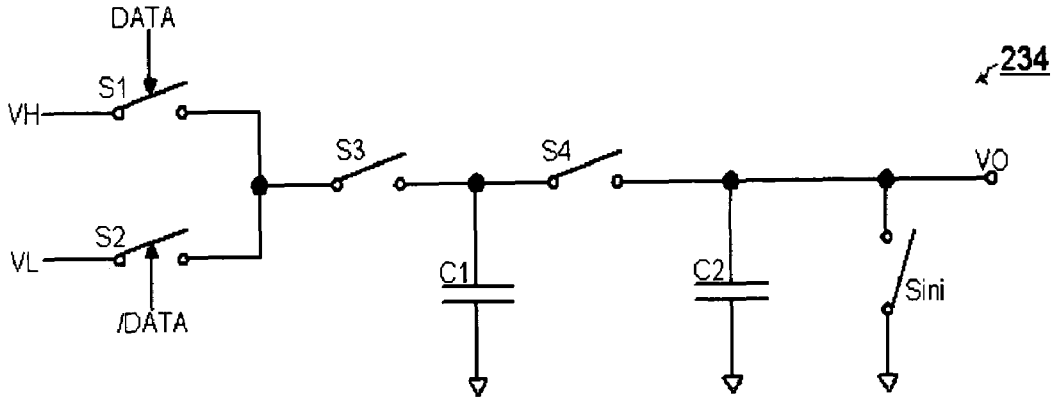
FIG. 9 shows components of a D/A (digital to analog) converter of FIGS. 4 and 7, according to an embodiment of the present invention.

The VH and VL voltages selected by the VH,VL selector 248 are used by the D/A converter 234. FIG. 9 shows an example embodiment of the D/A converter 234 which is a linear charge redistribution D/A converter. The D/A converter 234 includes a first switch S1 coupled to VH and a second switch S2 coupled to VL.

The other ends of the switches S1 and S2 are coupled to a third switch S3 which is in turn coupled to a first capacitor C1. A fourth switch S4 is coupled between the first capacitor C1 and a second capacitor C2. The second capacitor C2 is coupled to an initialization switch Sini. The first and second capacitors C1 and C2 have a same capacitance C in the example embodiment of FIG. 9.

Assume VL=0 Volts and assume that the least significant bits LSB[N-2] of the gray scale data D[N:1] are "1101". In that case, example operation of the linear charge redistribution D/A converter 234 is as follow:

(1) At first, the initialization switch Sini is closed to initialize the output voltage VO to 0 Volts. Thereafter, the switch Sini is turned off.

(2) The least significant bit "1" is used as DATA for controlling the first and second switches S1 and S2. Switch S3 is turned on, and with such DATA, switch S1 is turned on while switch S2 is turned off. Thereafter, switch S3 is turned off, and switch S4 is turned on. Thus, VO=VH/2.

(3) The next least significant bit "0" is used as DATA for controlling the first and second switches S1 and S2. Switch S4 is turned off, and switch S3 is turned on, and with such DATA, S1 is turned off while S2 is turned on. Thereafter, switch S3 is turned off, and switch S4 is turned on. Thus, VO=VH/4.

(4) The next least significant bit "1" is used as DATA for controlling the first and second switches S1 and S2. Switch S4 is turned off, and switch S3 is turned on, and with such DATA, S1 is turned on while S2 is turned off. Thereafter, switch S3 is turned off, and switch S4 is turned on. Thus, VO=5VH/8.

(5) The next least significant bit "1" is used as DATA for controlling the first and second switches S1 and S2. Switch S4 is turned off, and switch S3 is turned on, and with such DATA, S1 is turned on while S2 is turned off. Thereafter, switch S3 is turned off, and switch S4 is turned on. Thus, VO=13VH/16.

In this manner, the least significant bits LSB[N-2] of the gray scale data D[N:1] determine VO within the range between VH and VL. The most significant bits MSB[2] determine the values of VH and VL. The most significant bits MSB[2] and the least significant bits LSB[N-2] comprise the gray scale data D[N:1] latched in by the first and second latches 222 and 224. The analog voltage VO output by the D/A converter 234 is output to the output buffer 236, and such analog voltage VO is used to drive the source line 208 for the pixel 205.

Figure 10:
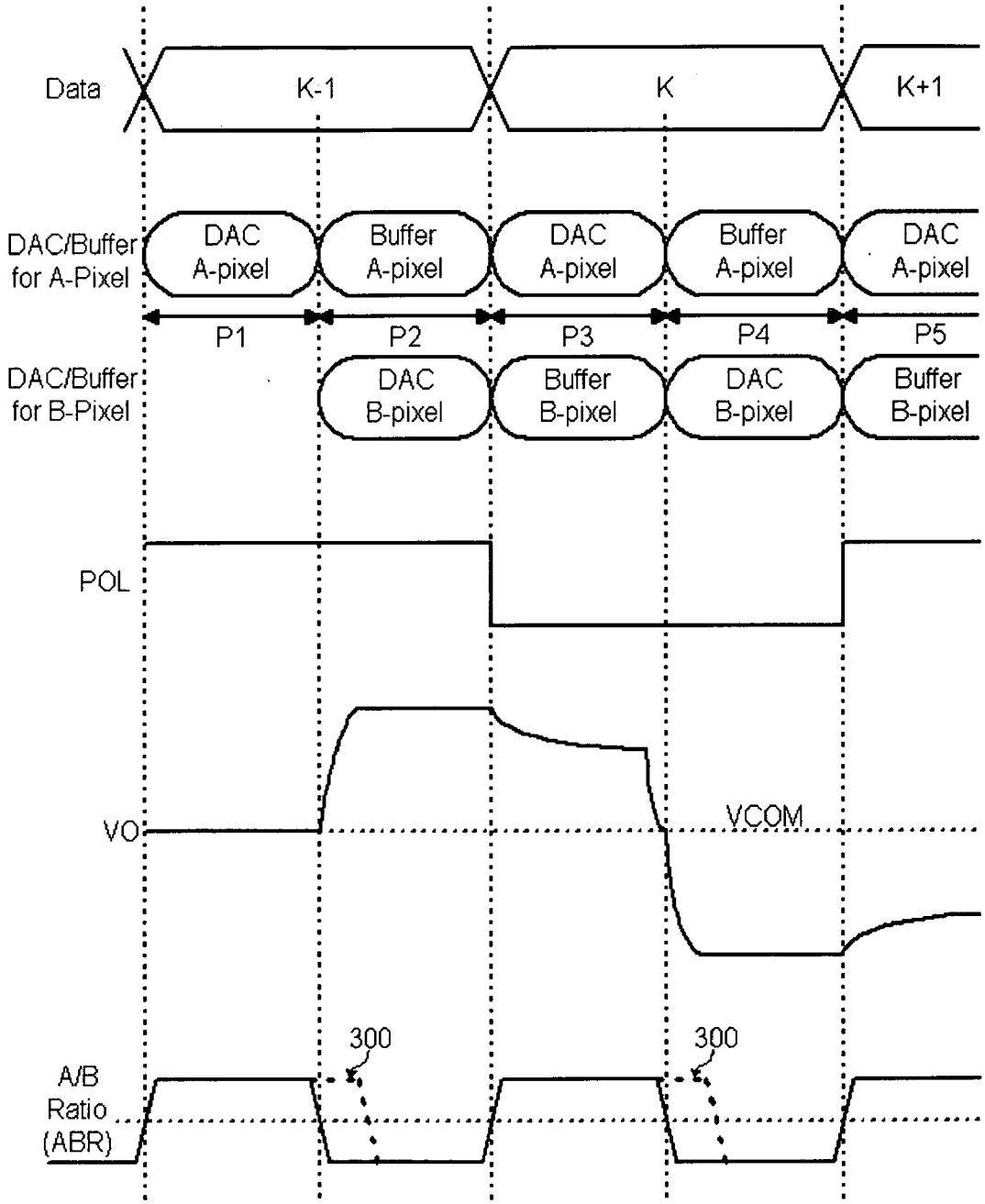
FIG. 10 shows a timing diagram of signals during operation of the source driver of FIG. 4, according to an embodiment of the present invention.

FIG. 10 shows a timing diagram of signals during operation of the source driver 214 of FIG. 4. During a first time period P1, the POL signal and the ABR signal are each at the logic high state "1" for inputting K-1 gray scale data D[N:1] in the first luminance curve 252 for the first sub-pixel 204.

During the first time period P1, the reference voltage generator 232 selects the VH and VL for defining one of the three ranges R1, R2, and R3 of the first luminance curve 252 depending on the most significant bits MSB[2] of the K-1 gray scale data D[N:1]. The D/A converter 234 generates the output voltage VO using such VH and VL and the least significant bits LSB[N-2] of the K-1 gray scale data D[N:1]. Such output voltage VO is used to drive the source line 208 for driving the first sub-pixel 204 during a second time period P2.

Also during the second time period P2, the POL signal remains at the logic high state "1", and the ABR signal changes to the logic low state "0". Thus, during the second time period P2, the reference voltage generator 232 selects the VH and VL for defining one of the three ranges R4, R5, and R6 of the second luminance curve 255 depending on the most significant bits MSB[2] of the K-1 gray scale data D[N:1]. The D/A converter 234 generates the output voltage VO using such VH and VL and the least significant bits LSB[N-2] of the K-1 gray scale data D[N:1]. Such output voltage VO is used to drive the source line 208 for driving the second sub-pixel 206 during a third time period P3.

Also during the third time period P3, the POL signal changes to the logic low state "0", and the ABR signal changes to the logic high state "1". Thus, during the third time period P3, the reference voltage generator 232 selects the VH and VL for defining one of the three ranges R7, R8, and R9 of the third luminance curve 256 depending on the most significant bits MSB[2] of a K gray scale data D[N:1]. The D/A converter 234 generates the output voltage VO using such VH and VL and the least significant bits LSB[N-2] of the K gray scale data D[N:1]. Such output voltage VO is used to drive the source line 208 for driving the first sub-pixel 204 during a fourth time period P4.

Also during the fourth time period P4, the POL signal remains at the logic low state "0", and the ABR signal changes to the logic low state "0". Thus, during the fourth time period P4, the reference voltage generator 232 selects the VH and VL for defining one of the three ranges R10, R11, and R12 of the fourth luminance curve 258 depending on the most significant bits MSB[2] of the K gray scale data D[N:1]. The D/A converter 234 generates the output voltage VO using such VH and VL and the least significant bits LSB[N-2] of the K gray scale data D[N:1]. Such output voltage VO is used to drive the source line 208 for driving the second sub-pixel 206 during a fifth time period P5.

Such operation is repeated for generating the output voltage VO according to each of the first, second, third, and fourth luminance curves 252, 254, 256, and 258. In this manner, one gray scale data D[N:1] is used for generating the respective output voltages VO for driving both of the sub-pixels 204 and 206. Periods P1 and P2 are during one line time for the K-1 gray scale data, and periods P3 and P4 are during another one line time for the K gray scale data.

Thus, the respective output voltages VO for driving both of the sub-pixels 204 and 206 are generated during one line time period for transferring one corresponding gray scale data. As a result, the data transfer rate and/or the data buses are minimized for the source driver 214 for in turn minimizing power consumption and EMI (electromagnetic interference).

The foregoing is by way of example only and is not intended to be limiting. For example, the present invention is described for the LCD. However, the present invention may be generalized for application in any type of display device. In addition, any number of elements or ranges as illustrated and described herein are by way of example.

Note that the duty cycle of the ABR signal in FIG. 10 may be varied depending on the ratio of the areas of the first and second liquid crystals LC-a and LC-b. For example, if the area of the first liquid crystal LC-a is larger than the area of the second liquid crystal LC-b, each of the time periods P1 and P3 for generating the output voltage VO driving the first sub-pixel 204 are longer (as shown by the dashed lines 300 in FIG. 10) than each of the time period P2 and P4 for driving the second sub-pixel 206.

The present invention is limited only as defined in the following claims and equivalents thereof.

The invention claimed is;

1. A method of generating source line voltages in a display device, comprising:

receiving by a source driver gray scale data for a first sub-pixel of a pixel having the first sub-pixel and a second sub-pixel;

wherein the source driver receives the gray scale data for the first sub-pixel during a one line time period while the source driver does not receive any gray scale information for the second sub-pixel during any portion of the one line time period;

generating by the source driver a first source line voltage for the first sub-pixel from the gray scale data during a first portion of said one line time period; and generating by the source driver a second source line voltage for the second sub-pixel of the pixel from the gray scale data of the first sub-pixel during a second portion of said one line time period such that the second source line voltage of the second sub-pixel becomes determined at the source driver during the second portion of said one line time period, wherein said one line time period is for a time length when a polarity signal remains constant during said time length, and wherein the polarity signal alternates between high and low logic states after each of said time length.

2. The method of claim 1, further comprising:

generating the first source line voltage from the gray scale data and a first luminance curve; and generating the second source line voltage from the gray scale data of the first sub-pixel and a second luminance curve.

3. The method of claim 2, wherein generating the first source line voltage includes the steps of:

selecting, from the first luminance curve, first high and low reference voltages for a D/A (digital to analog) converter depending on at least one most-significant bit of the gray scale data; and digital to analog converting at least one least-significant bit of the gray scale data at the D/A converter with the selected first high and low reference voltages.

4. The method of claim 3, wherein generating the second source line voltage includes the steps of:

selecting, from the second luminance curve, second high and low reference voltages for the D/A converter depending on the at least one most-significant bit of the gray scale data; and digital to analog converting the at least one least-significant bit of the gray scale data at the D/A converter with the selected second high and low reference voltages.

5. The method of claim 3, wherein the D/A converter is linear.

6. The method of claim 2, wherein the first and second luminance curves together are for upper gamma reference voltages or for lower gamma reference voltages.

7. The method of claim 6, wherein the first and second luminance curves are for the upper gamma reference voltages when the sub-pixels are driven for a positive polarity, and are for the lower gamma reference voltages when the sub-pixels are driven for a negative polarity.

8. The method of claim 6, wherein the luminance curves for the upper and lower gamma reference voltages are alternately used for generating successive sets of first and second source line voltages.

9. The method of claim 1, further comprising:

driving the first sub-pixel with the first source line voltage during said second portion of said one line time period; and driving the second sub-pixel with the second source line voltage during a portion of a subsequent one line time period after said one line time period.

10. A source driver of a display device, the source driver comprising:

a storage unit for receiving and storing gray scale data for a first sub-pixel of a pixel having the first sub-pixel and a second sub-pixel;

wherein the source driver receives the gray scale data for the first sub-pixel during a one line time period while the source driver does not receive any gray scale information for the second sub-pixel during any portion of the one line time period; and a source line voltage generator for generating a first source line voltage for the first sub-pixel from the gray scale data during a first portion of said one line time period, and for generating a second source line voltage for the second sub-pixel of the pixel from the gray scale data of the first sub-pixel during a second portion of said one line time period such that the second source line voltage of the second sub-pixel becomes determined at the source driver during the second portion of said one line time period, wherein said one line time period is for a time length when a polarity signal remains constant during said time length, and wherein the polarity signal alternates between high and low logic states after each of said time length.

11. The source driver of claim 10, wherein the source line voltage generator generates the first source line voltage from the gray scale data and a first luminance curve, and generates the second source line voltage from the gray scale data of the first sub-pixel and a second luminance curve.

12. The source driver of claim 11, wherein the source line voltage generator includes:

a D/A (digital to analog) converter; and a reference voltage generator for selecting, from the first and second luminance curve, first high and low reference voltages and second high and low reference voltages for the D/A converter depending on at least one most-significant bit of the gray scale data;

wherein the D/A converter converts at least one least-significant bit of the gray scale data with the selected first high and low reference voltages to generate the first source line voltage, and with the selected second high and low reference voltages to generate the second source line voltage.

13. The source driver of claim 12, wherein the reference voltage generator includes:

A/B selectors, each selecting a respective set of reference voltages from the luminance curves depending on which of the sub-pixels is to be driven;

an upper/lower selector for selecting one respective set of reference voltages from the A/B selectors depending on which polarity is indicated; and a VH,VL selector for selecting high and low reference voltages from the selected respective set of reference voltages depending on select signals generated from the at least one most-significant bit of the gray scale data.

14. The source driver of claim 12, wherein the D/A converter is linear.

15. The source driver of claim 12, wherein the D/A converter is a charge redistribution D/A converter.

16. The source driver of claim 11, wherein the first and second luminance curves together are for upper gamma reference voltages or for lower gamma reference voltages.

17. The source driver of claim 16, wherein the first and second luminance curves are for the upper gamma reference voltages when the sub-pixels are driven for a positive polarity, and are for the lower gamma reference voltages when the sub-pixels are driven for a negative polarity.

18. The source driver of claim 16, wherein the luminance curves for the upper and lower gamma reference voltages are alternately used for generating successive sets of first and second source line voltages.

19. The source driver of claim 10, wherein the first sub-pixel is driven with the first source line voltage during said second portion of said one line time period, and wherein the second sub-pixel is driven with the second source line voltage during a portion of a subsequent one line time period after said one line time period.

20. A display device comprising:

a display panel having a plurality of gate lines and source lines;

gate drivers for generating scan signals of the gate lines; and source drivers for generating source line voltages of the source lines, each source driver comprising:

a storage unit for receiving and storing gray scale data for a first sub-pixel of a pixel having the first sub-pixel and a second sub-pixel;

wherein the source driver receives the gray scale data for the first sub-pixel during a one line time period while the source driver does not receive any gray scale information for the second sub-pixel during any portion of the one line time period; and a source line voltage generator for generating a first source line voltage for the first sub-pixel from the gray scale data during a first portion of said one line time period, and for generating a second source line voltage for the second sub-pixel of the pixel from the gray scale data of the first sub-pixel during a second portion of said one line time period such that the second source line voltage of the second sub-pixel becomes determined at the source driver during the second portion of said one line time period, wherein said one line time period is for a time length when a polarity signal remains constant during said time length, and wherein the polarity signal alternates between high and low logic states after each of said time length.

21. The display device of claim 20, wherein the source line voltage generator generates the first source line voltage from the gray scale data and a first luminance curve, and generates the second source line voltage from the gray scale data of the first sub-pixel and a second luminance curve.

22. The display device of claim 21, wherein the source line voltage generator includes:

a D/A (digital to analog) converter; and a reference voltage generator for selecting, from the first and second luminance curves, first high and low reference voltages and second high and low reference voltages for the D/A converter depending on at least one most-significant bit of the gray scale data;

wherein the D/A converter converts at least one least-significant bit of the gray scale data with the selected first high and low reference voltages to generate the first source line voltage, and with the selected second high and low reference voltages to generate the second source line voltage.

23. The display device of claim 22, wherein the reference voltage generator includes:

A/B selectors, each selecting a respective set of reference voltages from the luminance curves depending on which of the sub-pixels is to be driven;

an upper/lower selector for selecting one respective set of reference voltages from the A/B selectors depending on which polarity is indicated; and a VH,VL selector for selecting high and low reference voltages from the selected respective set of reference voltages depending on select signals generated from the at least one most-significant bit of the gray scale data.

24. The display device of claim 22, wherein the D/A converter is linear.

25. The display device of claim 22, wherein the D/A converter is a charge redistribution D/A converter.

26. The display device of claim 21, wherein the first and second luminance curves together are for one of upper gamma reference voltages or lower gamma reference voltages.

27. The display device of claim 26, wherein the first and second luminance curves are for the upper gamma reference voltages when the sub-pixels are driven for a positive polarity, and are for the lower gamma reference voltages when the sub-pixels are driven for a negative polarity.

28. The display device of claim 26, wherein the luminance curves for the upper and lower gamma reference voltages are alternately used for generating successive sets of first and second source line voltages.

29. The display device of claim 20, wherein the display panel is a liquid crystal display (LCD) panel.

30. The display device of claim 20, wherein the first sub-pixel is driven with the first source line voltage during said second portion of said one line time period, and wherein the second sub-pixel is driven with the second source line voltage during a portion of a subsequent one line time period after said one line time period.

* * * * *